United States Patent [19]

Knodel et al.

[11] Patent Number: 4,596,120

[45] Date of Patent: Jun. 24, 1986

[54] APPARATUS AND METHOD FOR COLD AQUEOUS LIQUID AND/OR ICE PRODUCTION, STORAGE AND USE FOR COOLING AND REFRIGERATION

[75] Inventors: Bryan D. Knodel, Plainfield, Ill.; John S. Ludwigsen; Jill L. Ludwigsen, both of Cambridge, Mass.; Terry A. Gallagher, Wheaton, Ill.

[73] Assignee: Chicago Bridge & Iron Company, Oak Brook, Ill.

[21] Appl. No.: 676,822

[22] Filed: Nov. 30, 1984

Related U.S. Application Data

[63] Continuation-in-part of Ser. No. 559,477, Dec. 8, 1983.

[51] Int. Cl.[4] ..... F25D 3/00

[52] U.S. Cl. ..... 62/59; 62/123; 62/434; 62/534; 165/104.17

[58] Field of Search ..... 62/54, 59, 123, 434, 62/534; 165/104.17

[56] References Cited

U.S. PATENT DOCUMENTS

| | | | |
|---|---|---|---|
| 3,017,751 | 1/1962 | Hawkins | 62/58 |
| 3,017,752 | 1/1962 | Findlay | 62/58 |
| 3,156,101 | 11/1964 | McGuffey | 62/434 |
| 3,259,181 | 7/1966 | Ashley et al. | 165/107 |
| 3,369,371 | 2/1968 | Holly et al. | 62/54 |
| 3,835,658 | 9/1974 | Wilson | 62/123 |
| 4,046,534 | 9/1977 | Maguire | 62/534 |
| 4,111,260 | 9/1978 | Bricard et al. | 62/59 |
| 4,254,635 | 3/1981 | Simon et al. | 62/59 |
| 4,302,944 | 12/1981 | Gainer | 62/434 |

OTHER PUBLICATIONS

Kirk-Othmer "Encyclopedia of Chemical Technology" 2nd Ed., vol. 22, pp. 51-54, Interscience Publishers, John Wiley & Sons, 1970.

*Primary Examiner*—Ronald C. Capossela

*Attorney, Agent, or Firm*—Marshall, O'Toole, Gerstein, Murray & Bicknell

[57] ABSTRACT

A method comprising feeding a liquefied refrigerant gas into direct contact with aqueous liquid in an enclosed vessel to chill or cool the liquid and/or produce ice crystals and vaporize the refrigerant by heat exchange with the aqueous liquid; feeding a mixture of cold aqueous liquid and/or ice and refrigerant from the vessel to an enclosed storage tank to provide cold aqueous liquid and/or ice therein; removing refrigerant vapor from the storage tank; converting the refrigerant vapor to liquid refrigerant in a refrigeration cycle and feeding the liquid refrigerant back to the enclosed vessel; and withdrawing aqueous liquid from the storage tank and feeding it to the enclosed vessel; with all said refrigerant and aqueous liquid streams and volumes being in a single closed system such that refrigerant and aqueous liquid are not lost except by inadvertent leaks and consumption of such materials is avoided because they are not withdrawn from the system. Apparatus is also disclosed for practicing the described method.

32 Claims, 2 Drawing Figures

APPARATUS AND METHOD FOR COLD AQUEOUS LIQUID AND/OR ICE PRODUCTION, STORAGE AND USE FOR COOLING AND REFRIGERATION

This application is a continuation-in-part of application Ser. No. 559,477 filed Dec. 8, 1983.

This invention relates to apparatus for, and methods of, cooling. More particularly, this invention is concerned with novel apparatus and methods of cooling which include the storage of cooling capacity in the form of a cold aqueous liquid and/or ice and the subsequent use of the cold aqueous liquid and/or ice for any cooling purposes, including air conditioning and industrial installations which require cooling or refrigeration.

BACKGROUND OF THE INVENTION

Cooling and refrigeration requirements of industrial installations, as well as the central air conditioning of commercial buildings and industrial plants, requires large amounts of electrical energy to operate the refrigeration plants needed for these purposes. This places a high demand on electric utilities during on-peak periods, which usually are from about 9 A.M. to 10 P.M. Monday through Friday. Utilities must provide enough generating capacity to meet this demand. This requires a very high capital investment for plants and equipment which are fully utilized only in hot weather in daylight hours. Evenings and weekends are off-peak demand periods and much less of the total generating capacity is used then. In addition, less generating capacity is used on cool days in the spring and fall periods of the year in the United States.

To encourage a better or more uniform demand for electric power, many utilities charge a reduced rate for electricity used during off-peak periods. Business and industry have accordingly been looking for ways to shift or transfer as much as possible of their electrical consumption to off-peak periods to take advantage of the reduced rates and also to minimize future electric rate increases by making additional electric generating plants unnecessary, or at least delaying generating plant expansion.

It has been recognized for some time that a substantial potential savings could be realized if much of the refrigeration or air conditioning load could be moved from on-peak to off-peak periods. To do this, it has been proposed to operate refrigeration plants during off-peak periods to produce cold or chilled water or ice for storage. During on-peak periods the cold or chilled water or ice would then be used to provide cooling.

Because ice provides greater cooling capacity per unit volume than chilled water (a ratio of about 7:1) much commercial interest has been directed toward providing so-called ice making or ice building equipment for this purpose. At this time it appears that the type of ice maker or ice builder of greatest interest, and one which has been put into use in a number of installations, constitutes a tank, for holding water, through which a large number of small pipes run in one of several different patterns or arrangements. A liquid refrigerant is fed through the small pipes. As the refrigerant absorbs heat from the water, a layer of ice about 1 to 3 inches thick forms on each pipe. Ice is produced in this manner during off-peak periods.

When it becomes desirable to utilize the cooling potential stored in the ice for air conditioning or other purposes, a stream of water is fed through the tank to cool the water by exchange of heat to the ice. The cooled water is withdrawn from the tank and fed to a heat exchanger to provide the desired cooling. The resulting warm water is then returned to the tank to be cooled again by contact with the ice. This system can continue to provide cooling until all the ice is melted.

Ice makers or ice builders of the described type are costly to fabricate and operate. The pipes are not readily repaired or serviced. In addition, as the ice layer on the pipes increases in thickness, heat exchange between the water and refrigerant decreases because of the insulating effect which the ice provides. Furthermore, a very large heat exchange surface must be provided by the pipes to obtain the cooling needed to produce the desired quantity of ice.

From the above it is clear that a need exists for alternative apparatus and methods for ice making, storage and cooling which can operate with nearly constant efficiency during off-peak or, if desired, even during on-peak, electric load periods.

SUMMARY OF THE INVENTION

According to one aspect of the invention, there is provided a method comprising feeding a liquefied refrigerant into direct contact with a volume of aqueous liquid in an enclosed vessel to cool or chill the aqueous liquid and vaporize the refrigerant by heat exchange with the aqueous liquid; feeding a mixture of cold aqueous liquid and refrigerant from the vessel to an enclosed storage tank to provide cold aqueous liquid therein; removing refrigerant vapor from the storage tank; converting the refrigerant vapor to liquid refrigerant in a refrigeration cycle and feeding the liquid refrigerant back to the enclosed vessel; and withdrawing aqueous liquid from the storage tank and feeding it to the enclosed vessel; with all said refrigerant and aqueous liquid streams and volumes being in a single closed system such that refrigerant and aqueous liquid are not lost except by inadvertent leaks and consumption of such materials is avoided because they are not withdrawn from the system.

A more specific method can comprise feeding a liquefied refrigerant into direct contact with a volume of aqueous liquid in an enclosed ice making vessel to convert part of the liquid to ice crystals and vaporize the refrigerant by heat exchange with the aqueous liquid; feeding a mixture of liquid, ice crystals and vaporized refrigerant from the ice making vessel to an enclosed ice storage tank to provide an ice slurry and aqueous liquid therein; removing refrigerant vapor from the ice storage tank; converting the refrigerant vapor to liquid refrigerant in a refrigeration cycle and feeding the liquid refrigerant back to the ice making vessel; and withdrawing aqueous liquid from the ice storage tank and feeding it to the ice making vessel; with all said refrigerant and aqueous liquid streams and volumes being in a single closed system such that refrigerant and aqueous liquid are not lost except by inadvertent leaks and consumption of such materials is avoided because they are not withdrawn from the system.

The gaseous mixture withdrawn from the storage tank can be dewatered before the refrigerant vapor is returned to the refrigeration cycle. The water removed by the dewatering can be fed to the aqueous liquid cooling and/or ice making vessel. Alternatively, the gaseous mixture withdrawn from the ice storage tank can be returned to the refrigeration cycle without a prior dewatering. In converting the refrigerant vapor to refrigerant liquid, the water vapor will condense. The water which accumulates in the receiver can be fed to the aqueous liquid cooling and/or ice making vessel.

The refrigerant can have a boiling point slightly below 32° F. at one atmosphere absolute pressure. Alternately, the refrigerant used in the method can have a boiling point at or slightly above 32° F. at one atmosphere absolute pressure if vacuum vessels are used for both the production and storage of the cold aqueous liquid and/or ice. In each case, a pressure must be maintained in the tank such that the saturation temperature of the refrigerant used is below 32° F. to prevent the refrigerant vapor in the tank from condensing. Due to capital cost considerations, the refrigerant vapor pressure in the storage tank is desirably about one atmosphere absolute pressure at 32° F.

Refrigerant vapor which accumulates in the storage tank can be withdrawn therefrom and compressed in the refrigeration cycle or loop, then cooled and liquefied.

The method can also include removing cold aqueous liquid from the storage tank and feeding it through a heat exchanger in indirect heat exchange with a fluid to be cooled and used for cooling purposes, and then returning the then warm aqueous liquid exiting from the heat exchanger to the storage tank to be cooled by contact with the cold aqueous liquid and/or ice therein.

The aqueous liquid supplied to the heat exchanger, the cold aqueous liquid and/or ice storage tank and the cold aqueous liquid and/or ice producing vessel desirably is in direct contact or communication with itself as a common body of aqueous liquid in a closed system.

It is especially advantageous to cool or chill the aqueous liquid, or convert it to ice, primarily when the refrigeration cycle can be operated during an off-peak electric usage period to minimize electric power costs.

The method also includes, during on-peak electric usage periods, removing cold aqueous liquid from the storage tank and feeding it through a heat exchanger in indirect heat exchange with a fluid to be cooled and used for cooling purposes, and then returning the now warm aqueous liquid exiting from the heat exchanger to the storage tank to be cooled by contact with the cold aqueous liquid and/or ice therein, or to the vessel in which the aqueous liquid is cooled or chilled, with or without ice formation.

According to a further aspect of the invention apparatus is provided comprising an enclosed vessel in which an aqueous liquid can be cooled or chilled; a refrigeration loop comprising a refrigerant, a refrigerant vapor compressor, a refrigerant condenser and an expansion valve connected in series by refrigerant conduit means; a conduit for feeding liquid refrigerant from the expansion valve outlet into aqueous liquid in the vessel; a conduit for removing cooled aqueous liquid and refrigerant from the vessel and feeding it to an enclosed storage tank; a conduit for withdrawing refrigerant vapor from the storage tank and delivering the refrigerant to the refrigeration loop; a conduit for withdrawing aqueous liquid from the storage tank and returning it to the aqueous liquid cooling vessel; and said apparatus constituting a closed system such that refrigerant and aqueous liquid are not lost except by inadvertent leaks and consumption of such materials is avoided because they are not withdrawn from the apparatus in use.

More specifically, apparatus is provided comprising an enclosed ice making vessel which can contain an aqueous liquid; a refrigeration loop comprising a refrigerant vapor compressor, a refrigerant condenser and a Joule-Thompson expansion valve or pressure control valve connected in series by refrigerant conduit means; a conduit for feeding liquid refrigerant from the expansion valve outlet into aqueous liquid in the ice making vessel; a conduit for removing a mixture of ice, aqueous liquid and refrigerant vapor from the ice making vessel and feeding it to an enclosed ice storage tank; a conduit for withdrawing refrigerant vapor from the ice storage tank and delivering the refrigerant to the refrigeration loop; and a conduit for withdrawing aqueous liquid from the ice storage tank and returning it to the ice making vessel; said apparatus constituting a closed system such that refrigerant and aqueous liquid are not lost except by inadvertent leaks, and consumption of such materials is avoided because they are not withdrawn from the apparatus in use.

The apparatus can include dewatering means for removing water from the refrigerant vapor withdrawn from the storage vessel before the refrigerant vapor is returned to the refrigeration loop. The water which is removed can be fed from the dewatering means by a suitable conduit to the aqueous liquid cooling and/or ice making vessel to be cooled and/or converted to ice particles or crystals.

Alternatively, a mixture of refrigerant vapor and water vapor, withdrawn from the storage tank, can be returned to the refrigeration loop. It is then desirable to include in the refrigeration loop a conduit from the condenser to a refrigerant receiver. The water which condenses accumulates in the receiver. Conduit means is provided to feed the water from the receiver to the aqueous liquid cooling and/or ice making vessel.

The storage tank can be designed to store the cooled aqueous liquid and/or ice and refrigerant vapor at an interior absolute pressure of about one atmosphere so as to minimize construction costs and capital investment. Alternatively, if the refrigerant used has a boiling point at or slightly above 32° F. at one atmosphere absolute pressure, the storage tank can be designed to operate at an internal pressure such that the saturation temperature of the refrigerant is below 32° F.

For cooling uses, the apparatus should include means for removing cold aqueous liquid from the storage tank and feeding it to a heat exchanger to cool fluid used for cooling purposes; and means for removing warm aqueous liquid from the heat exchanger and feeding it to the storage tank, or to the aqueous liquid cooling and/or ice making vessel, or partially to each.

The refrigerant used can be butane, isobutane, a chloro or fluoro substituted derivative of butane or isobutane and especially octafluorocyclobutane, a chloro and/or fluoro substituted derivative of methane or ethane, and especially dichlorotetrafluoroethane (a mixture of 1,2-dichloro-1,1,2,2-tetrafluoroethane and 1,1-dichloro-1,2,2,2-tetrafluoroethane) or a mixture of any of these refrigerants such as a mixture of dichlorotetrafluoroethane and dichlorodifluoromethane.

Any suitable aqueous liquid can be employed in the apparatus and method. All such liquids are usually referred to in the refrigeration art as "brine". Some such brines are pure water, solutions of water and a salt, such as sodium chloride or calcium chloride, and mixtures of water and a glycol, such as ethylene glycol.

DETAILED DESCRIPTION OF THE DRAWINGS

To the extent it is reasonable and practical, the same or similar elements or parts which appear in the various views of the drawings will be identified by the same numbers.

Figure 1:
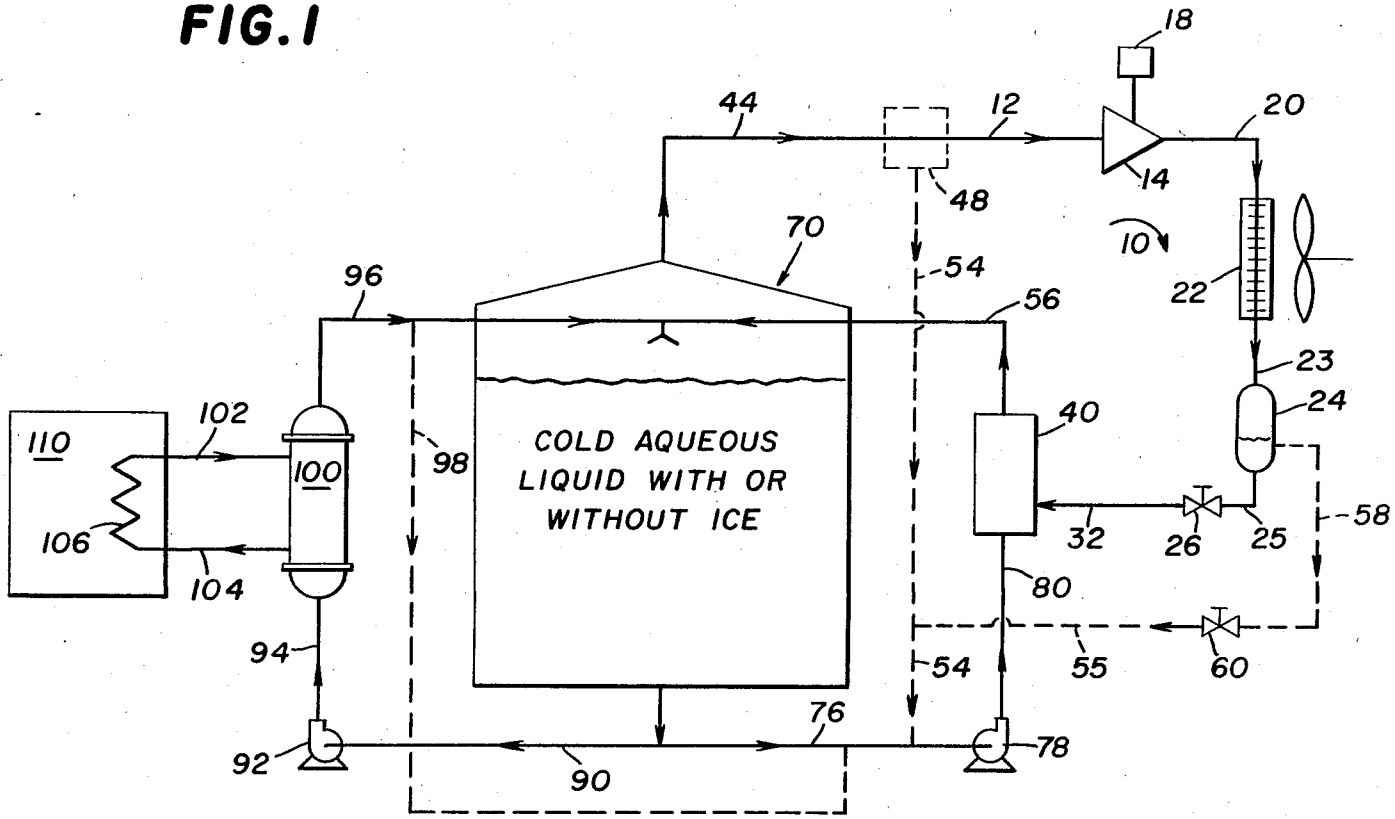
FIG. 1 is a schematic drawing illustrating a first embodiment of apparatus according to the invention.

With reference to FIG. 1, the combination of apparatus illustrated schematically in that drawing includes a refrigeration loop or cycle 10 having a refrigerant compressor 14 driven by electric motor 18, a refrigerant condenser 22, receiver 24 and expansion valve 26. Refrigerant vapor is supplied to compressor 14 by conduit 12. Compressed refrigerant vapor exits compressor 14 into conduit 20 which feeds it to condenser 22 in which it is cooled and liquefied. The liquid refrigerant under high pressure exits condenser 22 into conduit 23 which feeds it to receiver 24. The liquid refrigerant exits the receiver 24 into conduit 25 which feeds it to expansion valve 26. The refrigerant exits expansion valve 26 into conduit 32 which feeds it to vessel 40.

Any suitable refrigerant having a boiling point below 32° F. at one atmosphere absolute pressure is preferably used in the described system. However, the embodiment of FIG. 1 will be described with specific reference to use of octafluorocyclobutane or a mixture of refrigerants comprised of 70% R-114 and 30% R-12 more or less. R-114 is a mixture of 1,2-dichloro-1,1,2,2-tetrafluoroethane and 1,1-dichloro-1,2,2,2-tetrafluoroethane. R-12 is dichlorodifluoromethane. Furthermore, the aqueous liquid can be water or a brine comprising an aqueous solution of a glycol such as ethylene glycol, or of a salt such as sodium chloride.

Conduit 32 can project inside of vessel 40 and be provided with a plurality of holes through which the refrigerant can flow out into direct contact with the volume of aqueous liquid in the vessel 40. As a result of heat exchange from the water to the refrigerant, the aqueous liquid is cooled while the refrigerant vaporizes. A mixture of cold or chilled aqueous liquid and refrigerant is withdrawn from vessel 40 by conduit 56 and fed to storage tank 70. The mixture can include ice crystals if the aqueous liquid is cooled low enough to produce ice in vessel 40.

Refrigerant vapor containing water is removed from storage tank 70 by conduit 44 and delivered to refrigerant dewatering vessel 48 in which the refrigerant vapor is essentially freed of water. The dewatered refrigerant vapor is removed from vessel 48 by conduit 12 for delivery to compressor 14. Water separated in dewatering vessel 48 is withdrawn therefrom by conduit 54 and returned to vessel 40 through pump 78 and conduit 80. Alternatively, condensed water vapor may be removed from refrigerant receiver 24. Water can be fed from receiver 24 through conduit 58, pressure reducing valve 60 and conduit 55 to pump 78. Conduit 80 receives the water from the pump and delivers it to vessel 40.

Aqueous liquid or brine is withdrawn from the bottom of tank 70 through conduit 76 and fed through pump 78 to conduit 80 which recycles the liquid to vessel 40 to be further cooled.

Storage tank 70 is desirably constructed to hold the maximum amount of cold aqueous liquid or brine alone or with ice with a minimum capital investment. For this reason, a flat bottom tank with a circular cylindrical shell for the wall and a conical or dome roof is desirably employed. The tank is designed, however, to store the cooled aqueous liquid and/or ice and refrigerant vapor at about an internal absolute pressure of one atmosphere. The internal pressure is to be low enough to prevent condensation of refrigerant in the tank.

The apparatus so far described in conjunction with FIG. 1 is a closed system and no aqueous liquid or refrigerant is withdrawn from it except inadvertently, such as by a leak.

The described method can be used to produce only cold aqueous liquid or brine for storage in tank 70 or it can be operated primarily to produce ice for cooling purposes. Thus, it can be operated as long as desired to produce as little or as much cold brine or ice for storage as may be suitable for particular circumstances. When ice is produced it generally will proceed until the ice storage tank 70 is one-half to three-fourths full of ice with the balance liquid. Thus, enough ice can be produced to have it approach the tank bottom. Since brine flows through the ice, brine can be withdrawn readily from the tank bottom. For most economical ice making, the apparatus is operated for ice making when electricity rates are the lowest, i.e. at off-peak periods, which usually are Sunday to Thursday evenings from about 10 P.M. to 9 A.M. the following morning, and weekends from 10 P.M. Friday to Sunday evening.

The cooling capacity of the cold aqueous liquid and/or ice can be utilized for any cooling purpose, including air conditioning. Thus, cold brine can be withdrawn from tank 70 by conduit 90 and fed to pump 92 powered by an electric motor (not shown). The cold brine is fed from pump 92 to conduit 94 which feeds it to heat exchanger 100. The cold brine flows in indirect heat exchange with a warm fluid supplied by conduit 102 to heat exchanger 100. The brine, thereby warmed, is withdrawn from the heat exchanger 100 by conduit 96 and fed into the top of tank 70. The warm brine forms a top layer on cold brine in tank 70 when the tank is full of liquid. If the tank contains primarily ice, the warm brine is cooled as it flows downwardly through the ice. In each case, brine can be withdrawn at the bottom as cold brine. Alternatively, the warm brine can be fed from conduit 96 to conduit 98, shown as a dashed line, and then delivered through conduit 76, pump 78 and conduit 80 to ice making vessel 40 to be cooled again.

The warm fluid supplied by conduit 102 to heat exchanger 100 is removed therefrom as cold fluid by conduit 104 and circulated through cooling coil 106 in facility or load 110 to provide the necessary cooling or refrigeration.

This system can continue to operate so long as cold brine and/or ice is available in the storage tank 70. Desirably, the amount of cold brine and/or ice in the tank available for cooling should be adequate for the intended cooling purpose.

The described aqueous liquid cooling and/or ice making and storage apparatus can be operated at any time, whether during on-peak or off-peak periods of electrical usage. It is generally less expensive, and thus economically advantageous, to produce cold aqueous liquid and/or ice during off-peak periods of electrical consumption when the rates are low. The cooling capacity stored in the form of cold aqueous liquid and/or ice can then be used during on-peak periods for industrial cooling and refrigeration purposes, including air conditioning, and if desired cold aqueous liquid and/or ice can be made simultaneously by operating the refrigeration system 10.

A further advantage of the described apparatus lies in the use of the same liquid in storage tank 70 and heat exchanger 100. This makes construction of the apparatus and its operation comparatively simple and less expensive than many others.

The described aqueous liquid cooling and/or ice making and cooling system can be used as the main cooling system for any industrial cooling or refrigeration purpose, including air conditioning a building, whether operated entirely or primarily during on-peak or off-peak electrical usage periods, or a combination thereof. The system also can be used to shift part of a present existing cooling load to off-peak periods by using it to supplement an existing conventional cooling system, such as an air conditioning system. Furthermore, the system can be used in refrigeration load leveling by using it in combination with a smaller conventional refrigeration system.

Figure 2:
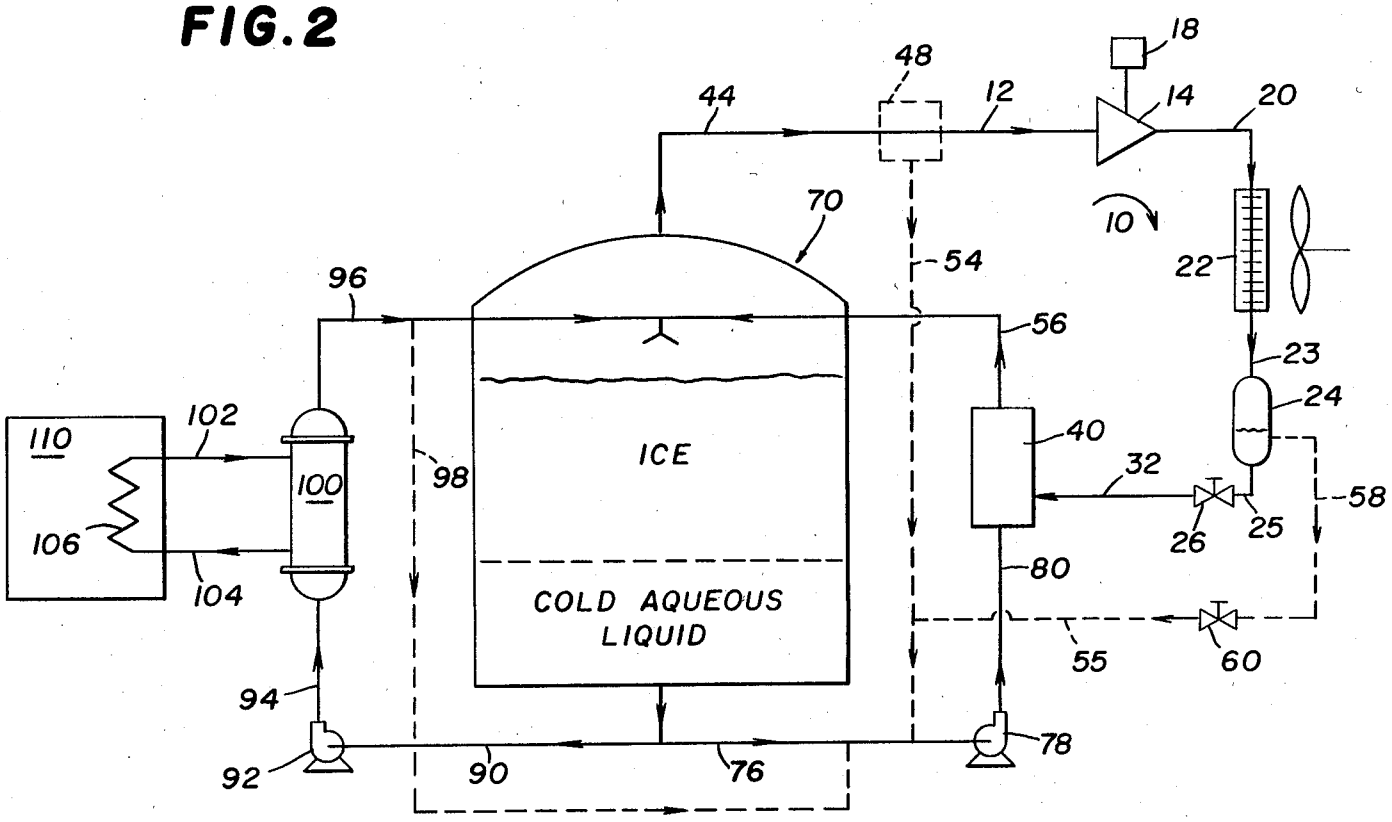
FIG. 2 is a schematic drawing illustrating a second embodiment of apparatus according to the invention using a slightly lower pressure in the storage tank.

A second embodiment of apparatus provided by the invention is illustrated in FIG. 2. Much of the equipment is common to both apparatus embodiments. That which is common will not be described again. However, the apparatus of FIG. 2 is designed for use of a refrigerant gas having a boiling point at or above 32° F. at one atmosphere absolute pressure while the FIG. 1 embodiment is designed to use a refrigerant gas having a boiling point below 32° F. at that pressure. A specific refrigerant suitable for use in the FIG. 2 embodiment, and upon which the data in the drawing is based, is R 114 comprising a mixture of 1,2-dichloro-1,1,2,2-tetrafluoroethane and 1,1-dichloro-1,2,2,2-tetrafluoroethane.

The system illustrated by FIG. 2 is operated like that of FIG. 1 except that the vessel 40 and storage tank 70 are maintained at a partial vacuum (4–8 in. Hg.). A dome roof tank is employed, in this case, to provide structural strength so that the internal pressure can be maintained sufficiently low to prevent condensation of refrigerant in tank 70. The flat bottom is acceptable since the hydrostatic force of the water should exceed the partial vacuum for water depths in the 8–10 ft. range.

The embodiment of FIG. 2 can be operated both during on-peak and off-peak periods of electrical usage. Desirably, it is operated to produce cold aqueous liquid and/or make ice during off-peak periods so that during on-peak periods the cold liquid and/or ice in the storage tank can be used for any industrial cooling or refrigeration purpose, such as air conditioning.

The FIG. 2 embodiment is a closed system and no brine or refrigerant is consumed in cooling the aqueous liquid and/or making ice or in their subsequent use for cooling purposes.

The foregoing detailed description has been given for clearness of understanding only, and no unnecessary limitations should be understood therefrom, as modifications will be obvious to those skilled in the art.

What is claimed is:

1. A method comprising:

feeding a liquefied refrigerant into direct contact with a volume of aqueous liquid in an enclosed vessel to cool or chill the aqueous liquid and vaporize the refrigerant by heat exchange with the aqueous liquid;

feeding a mixture of cold aqueous liquid and refrigerant from the vessel to an enclosed storage tank to provide cold aqueous liquid therein;

removing refrigerant vapor from the storage tank;

converting the refrigerant vapor to liquid refrigerant in a refrigeration cycle and feeding the liquid refrigerant back to the enclosed vessel; and withdrawing aqueous liquid from the storage tank and feeding it to the enclosed vessel;

with all said refrigerant and aqueous liquid streams and volumes being in a single closed system such that refrigerant and aqueous liquid are not lost except by inadvertent leaks and consumption of such materials is avoided because they are not withdrawn from the system.

2. A method comprising:

feeding a liquefied refrigerant into direct contact with a volume of aqueous liquid in an enclosed ice making vessel to convert part of the liquid to ice crystals and vaporize the refrigerant by heat exchange with the aqueous liquid;

feeding a mixture of liquid, ice crystals and vaporized refrigerant from the ice making vessel to an enclosed ice storage tank to provide an ice slurry and aqueous liquid therein;

removing refrigerant vapor from the ice storage tank;

converting the refrigerant vapor to liquid refrigerant in a refrigeration cycle and feeding the liquid refrigerant back to the ice making vessel; and withdrawing aqueous liquid from the ice storage tank and feeding it to the ice making vessel;

with all said refrigerant and aqueous liquid streams and volumes being in a single closed system such that refrigerant and aqueous liquid are not lost except by inadvertent leaks and consumption of such materials is avoided because they are not withdrawn from the system.

3. A method according to claim 1 or 2 in which the refrigerant has a boiling point below 32° F. at one atmosphere absolute pressure.

4. A method according to claim 3 in which the pressure in the storage tank is maintained at about one atmosphere absolute pressure.

5. A method according to claim 1 or 2 in which the refrigerant has a boiling point at or above 32° F. at one atmosphere absolute pressure.

6. A method according to claim 5 in which the pressure in the storage tank is maintained sufficiently low to prevent condensation of refrigerant in the tank at the refrigeration storage temperature in the tank.

7. A method according to claim 1 or 2 in which the pressure in the enclosed vessel and in the storage tank is maintained at a pressure up to about one atmosphere absolute pressure.

8. A method according to claim 1 or 2 in which the refrigerant vapor withdrawn from the storage tank contains water vapor and is dewatered before the refrigerant vapor is returned to the refrigeration cycle.

9. A method according to claim 8 in which the water removed from the refrigerant vapor is fed to the enclosed vessel.

10. A method according to claim 1 or 2 in which the refrigerant vapor withdrawn from the storage tank contains water vapor and is fed to the refrigeration cycle, the liquid refrigerant containing condensed water is fed from the condenser to a receiver where the water separates, and the water is fed from the receiver to the enclosed vessel.

11. A method according to claim 1 or 2 including removing cold aqueous liquid from the storage tank and feeding it through a heat exchanger in indirect heat exchange with a fluid to be cooled and used for cooling purposes, and then returning the now warm aqueous liquid exiting from the heat exchanger to the storage tank.

12. A method according to claim 11 in which the aqueous liquid supplied to the heat exchanger, the storage tank and the enclosed vessel is a common body of aqueous liquid in a closed system.

13. A method according to claim 1 or 2 in which the refrigeration cycle is operated during off-peak electric usage.

14. A method according to claim 1 or 2 including during on-peak electric usage periods, removing cold aqueous liquid from the storage tank and feeding it through a heat exchanger in indirect heat exchange with a fluid to be cooled and used for cooling purposes, and then returning the now warm aqueous liquid exiting from the heat exchanger to the storage tank to be cooled by contact with cold aqueous liquid and/or ice therein, or to the enclosed vessel.

15. A method according to claim 1 or 2 wherein the aqueous liquid is a mixture of water and a liquid glycol.

16. A method according to claim 1 or 2 wherein the aqueous liquid is a mixture of water and a salt.

17. A method according to claim 1 or 2 wherein the aqueous liquid is water.

18. Apparatus comprising:

an enclosed vessel in which an aqueous liquid can be cooled or chilled;

a refrigeration loop comprising a refrigerant, a refrigerant vapor compressor, a refrigerant condenser and an expansion valve connected in series by refrigerant conduit means; a conduit for feeding liquid refrigerant from the expansion valve outlet into aqueous liquid in the vessel;

a conduit for removing cooled aqueous liquid and refrigerant from the vessel and feeding it to an enclosed storage tank;

a conduit for withdrawing refrigerant vapor from the storage tank and delivering the refrigerant to the refrigeration loop;

a conduit for withdrawing aqueous liquid from the storage tank and returning it to the aqueous liquid cooling vessel; and said apparatus constituting a closed system such that refrigerant and aqueous liquid are not lost except by inadvertent leaks and consumption of such materials is avoided because they are not withdrawn from the apparatus in use.

19. Apparatus comprising:

an enclosed ice making vessel which can contain an aqueous liquid;

a refrigeration loop comprising a refrigerant, a refrigerant vapor compressor, a refrigerant condenser and an expansion valve connected in series by refrigerant conduit means; a conduit for feeding liquid refrigerant from the expansion valve outlet into aqueous liquid in the ice making vessel;

a conduit for withdrawing refrigerant vapor from the ice storage tank and delivering the refrigerant to the refrigeration loop;

a conduit for removing a mixture of ice, aqueous liquid and refrigerant vapor from the ice making vessel and feeding it to an enclosed ice storage tank; and a conduit for withdrawing aqueous liquid from the ice storage tank and returning it to the ice making vessel; and said apparatus constituting a closed system such that refrigerant and aqueous liquid are not lost except by inadvertent leaks and consumption of such materials is avoided because they are not withdrawn from the apparatus in use.

20. Apparatus according to claim 18 or 19 including dewatering means in the conduit for withdrawing refrigerant vapor from the storage tank and feeding the refrigerant vapor to the refrigeration loop.

21. Apparatus according to claim 20 including conduit means for withdrawing water from the dewatering means and feeding it to the enclosed vessel.

22. Apparatus according to claim 18 or 19 in which the refrigeration loop includes a liquid refrigerant receiver in the conduit from the condenser to the expansion valve, and a conduit extends from the receiver to the enclosed vessel for feeding water, which condenses in the refrigeration loop and separates in the receiver, from the receiver to the enclosed vessel.

23. Apparatus according to claim 18 or 19 including a refrigerant having a boiling point below 32° F. at one atmosphere absolute pressure.

24. Apparatus according to claim 18 or 19 including a refrigerant having a boiling point at or above 32° F. at one atmosphere absolute pressure.

25. Apparatus according to claim 18 or 19 in which the storage tank is designed to store the cooled aqueous liquid and/or ice and refrigerant vapor at about an interior absolute pressure of one atmosphere.

26. Apparatus according to claim 18 or 19 in which the storage tank is constructed so that the internal pressure can be maintained sufficiently low to prevent condensation of refrigerant in the tank at the temperature therein.

27. Apparatus according to claim 18 or 19 including:

means for removing cold aqueous liquid from the storage tank and feeding it to a heat exchanger to cool fluid used for cooling purposes; and means for removing warm aqueous liquid from the heat exchanger and feeding it to the storage tank, or to the vessel, or partially to both.

28. Apparatus according to claim 18 or 19 in which the refrigerant is a chloro and/or fluoro substituted derivative of methane, ethane or butane.

29. Apparatus according to claim 28 in which the refrigerant is octafluorocyclobutane or a mixture of dichlorotetrafluoroethane and dichlorodifluoromethane.

30. Apparatus according to claim 28 in which the refrigerant is dichlorotetrafluoroethane.

31. Apparatus according to claim 18 or 19 including in the tank an aqueous liquid which is a solution of a glycol or a solution of a salt.

32. Apparatus according to claim 18 or 19 including water in the tank.

* * * * *

UNITED STATES PATENT AND TRADEMARK OFFICE

CERTIFICATE OF CORRECTION

PATENT NO. : 4,596,120

DATED : June 24, 1986

INVENTOR(S) : Bryan D. Knodel et al

It is certified that error appears in the above-identified patent and that said Letters Patent is hereby corrected as shown below:

Column 10, lines 1 to 3, delete these lines and insert the identical material as a paragraph between lines 6 and 7.

Signed and Sealed this

Twenty-second Day of November, 1988

*Attest:*

DONALD J. QUIGG

*Attesting Officer*

*Commissioner of Patents and Trademarks*